US008210458B2

(12) United States Patent
Strasser et al.

(10) Patent No.: US 8,210,458 B2
(45) Date of Patent: Jul. 3, 2012

(54) RECIRCULATING GRINDING MILL WITH EXTERNAL RISERS

(75) Inventors: Siegfried Strasser, Much (DE); Stefan Seemann, Mettmann (DE)

(73) Assignee: KHD Humboldt Wedag GmbH, Cologne (DE)

( * ) Notice: Subject to any disclaimer, the term of this patent is extended or adjusted under 35 U.S.C. 154(b) by 0 days.

(21) Appl. No.: 12/937,484

(22) PCT Filed: Apr. 8, 2009

(86) PCT No.: PCT/EP2009/054179

§ 371 (c)(1), (2), (4) Date: Dec. 20, 2010

(87) PCT Pub. No.: WO2009/124952

PCT Pub. Date: Oct. 15, 2009

(65) Prior Publication Data

US 2011/0204170 A1 Aug. 25, 2011

(30) Foreign Application Priority Data

Apr. 11, 2008 (DE) ..... 10 2008 018 488
Apr. 19, 2008 (DE) ..... 10 2008 019 830

(51) Int. Cl.
*B02C 23/22* (2006.01)
*B02C 4/02* (2006.01)

(52) U.S. Cl. ..... 241/79.1; 241/135; 241/80

(58) Field of Classification Search ..... 241/135, 241/143, 80, 79.1
See application file for complete search history.

(56) References Cited

U.S. PATENT DOCUMENTS 7,300,007 B2 * 11/2007 Hagedorn et al. ..... 241/79.1
7,896,272 B2 * 3/2011 Frangenberg et al. ..... 241/135
2005/0284971 A1 * 12/2005 Hagedorn et al. ..... 241/79.1

FOREIGN PATENT DOCUMENTS

DE 10 2006 004282 8/2007
DE 20 2007 016785 4/2009
WO WO 03/097241 11/2003

* cited by examiner

*Primary Examiner* — Faye Francis
(74) *Attorney, Agent, or Firm* — Greer, Burns & Crain, Ltd.

(57) ABSTRACT

A recirculating grinding mill, including at least two rolling presses for comminuting the material to be ground, at least two first classifiers for classifying a coarse-grain fraction, at least one second classifier for classifying a fine-grain fraction and a medium-grain fraction from the fractions classified in the at least two first classifiers. The feedstock is fed into the recirculating grinding mill passing the at least two rolling presses and the at least two first classifiers and then the at least one second classifier and the medium-grain fraction and the coarse fraction of the at least two first classifiers being fed once again to the rolling presses, and the at least two first classifiers being arranged underneath the at least two rolling presses. The rolling presses are placed between at least two risers for transporting the circulating material being ground.

20 Claims, 4 Drawing Sheets prior art

RECIRCULATING GRINDING MILL WITH EXTERNAL RISERS

BACKGROUND OF THE INVENTION

The invention relates to a recirculating grinding mill, comprising: at least two rolling presses for comminuting the material to be ground, at least two first classifiers for classifying a coarse-grain fraction, at least one second classifier for classifying a fine-grain fraction and a medium-grain fraction from the fractions classified in the at least two first classifiers, the feedstock fed into the recirculating grinding mill passing the at least two rolling presses and the at least two first classifiers and then the at least one second classifier and the medium-grain fraction and the coarse fraction of the at least two first classifiers being fed once again to the rolling presses, and the at least two first classifiers being arranged underneath the at least two rolling presses.

In known recirculating grinding mills, feedstock to be ground is comminuted by a rolling press, in which the coarse material to be ground is passed through a narrow gap between two rolls. Depending on the nature of the material, press scabs thereby form and are broken up by further disagglomeration into the comminuted constituents. At the same time, the constituents that have not been comminuted to a small enough size are subjected to renewed comminution in the roll gap and the finer constituents are subjected to further classification, with the fine fraction being continuously removed from the recirculated material being ground. In order to maintain the recirculation of the material being ground, the press scabs and/or the material emerging from the disagglomeration stage are mechanically and/or pneumatically raised and fed again to the comminuting roll gap. A bucket mechanism is generally used for raising the material being ground, but combinations of pneumatic and mechanical lifting mechanisms have also proven effective in practice.

In order to increase the throughput of such mills, it is possible to operate more than one mill parallel next to one another, similar to a further mill. In order to save costs and plant expenditure, however, it is usual in this case to share the classifiers and/or the transporting arrangements between the recirculating grinding mills. The shared use of a mechanism, such as a classifier or elevator, also has the effect that a mixing of the fractions ground in the different mills takes place. As a result, this in turn avoids greatly varying grain size distributions in the fractions of different circuits.

However, there are usually limits to how much the plant capacity can be increased, as a result of limited availability of space and/or plant costs caused by the structural measures for maintaining and servicing the plant or for protecting it from the weather. In particular, the servicing expenditure of such a plant increases as the individual parts of the plant are installed closer together, since, for example, in this case the rolling presses or the movable parts of classifiers and/or lifting mechanisms can no longer be easily reached.

SUMMARY OF THE INVENTION

The object of the invention is therefore to provide a recirculating grinding mill which has low space requirements and is nevertheless easy to service.

The object is achieved by providing transport of the fractions classified in the at least two first classifiers through at least two risers, the at least two rolling presses being arranged between the at least two risers.

According to the invention, it is proposed to arrange risers for the recirculation of the material being ground in such a way that the rolling presses are arranged within the arrangement of risers, that is to say between them. The resultant enforced external arrangement of the risers allows shared use of a single lifting crane for the servicing of the rolling presses, for example in order to exchange the individual rolls of the rolling press.

Furthermore, this arrangement allows the risers to be used at the same time as supports for arranging the plant in a building to provide protection from the weather. By being placed at statically favorable locations, for example on the rolling press platform, the external risers are suitable in particular for undertaking a load-bearing function for a roofing element, so that there is no need for separately erected load-bearing elements for a plant building, or at least they can be made to smaller dimensions.

To share a single lifting crane for the rolling presses lying on the inside as a result of the central arrangement, it has proven to be advantageous if a cable of the lifting crane is arranged centrally between the working positions of the rolling presses. If a rolling press is to be serviced, for example by changing one or two rolls, the corresponding rolling press is displaced into the position of the lifting crane, the lifting crane lifts the rolls out of the displacement arrangement, then the roll can be let down. It is presupposed in this case that the rolling presses in the recirculating grinding mill are on a platform above the level of the floor. On this platform it is possible to displace the rolling presses and move them into or out of the lifting path of the cable of the lifting crane.

In the risers of the recirculating grinding mill, some of the material fed to the first classifiers is lifted pneumatically. On the other hand, the coarse material falling out from underneath the first classifiers is lifted mechanically, for example by a bucket mechanism. In this case, the classifying and drying gases are used for lifting the disagglomerated material being ground out of the first classifier into the second classifier for disagglomeration.

BRIEF DESCRIPTION OF THE DRAWINGS

The invention is explained in more detail on the basis of the following figures, in which.

DETAILED DESCRIPTION OF THE PREFERRED EMBODIMENTS

Figure 1:
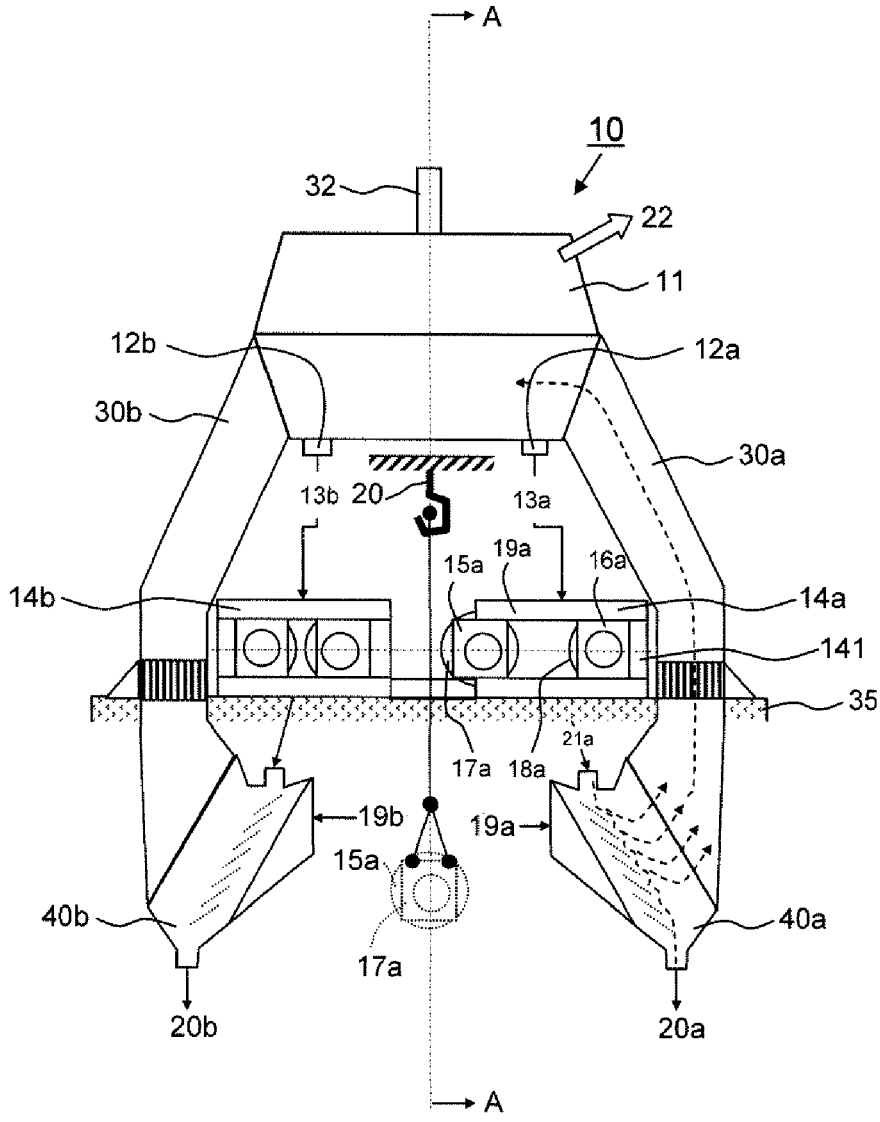
FIG. 1 shows a recirculating grinding mill according to the invention in a first view, only the main units being shown.

In FIG. 1, a recirculating grinding mill 4 according to the invention is represented in a first view, in which the individual mechanisms of the recirculating grinding mill 10 can be easily seen. These are a shared rod cage classifier 11, the medium-material discharge openings 12*a* and 12*b* of which respectively direct a stream of medium material 13*a* and 13*b* into the corresponding rolling presses 14*a* and 14*b* and into which the fresh material to be ground is also fed. During operation of the plant, however, it is optionally possible to feed the fresh material to be ground to the rolling presses or into the second classifiers. If the fresh material is fed to the first classifiers, it is advantageous that moisture is driven out of the fresh material by the hot classifying air, so that the material being ground flows into the further parts of the plant in a pre-dried state. The corresponding feeding of fresh material has not been depicted to avoid unnecessary details and to simplify the representation. The rolling presses 14*a* and 14*b* are charged with a mixture of fresh material, medium material and coarse material and for their part comprise individual parts which are described on the basis of the rolling press 14*a*. The arrangement of the different rolling presses 14*a* and 14*b* according to the invention achieves the effect of a series of various advantages, which will be further discussed later in the text. The individual parts of the rolling press 14*a* are the machine frame 141, the roll bearings 15*a* and 16*a* and the grinding rolls 17*a* and 18*a*. Once the mixture of fresh material, medium material and coarse material has passed the roll gap between the grinding rolls 17*a* and 18*a*, with the rolling press 14*a* being represented in the drawing in the servicing state while the rolling press 14*b* is represented in the working state, the material being ground that is comminuted together is discharged again from underneath the rolling press 14*a*. During the pressing operation in the rolling press, press scabs of comminuted material being ground form and are disagglomerated in the next mechanism of the plant. The static V classifier 40*a* uses classifying air 19*a* to separate the stream of ground material 21*a* emerging from the rolling press 14*a*, with the coarse-material discharge 20*a* being recirculated back into the rolling press. The fine fraction separated in this classifier 40*a*, however, is pneumatically transported by the stream of classifying air 19*a*, as indicated by the dashed arrows, upward through the riser 30*a* to a level above the rolling press 14*a*. There, this fine material enters the rod cage classifier 11 mentioned at the beginning, where the fine material originating from the V classifier 40*a* is separated into a medium-material fraction and a fine-material fraction. The stream of fine material 22 then leaves the rod cage classifier through an arrangement not depicted any more specifically, which is indicated at the top right by an arrow. The stream of medium material separated in this rod cage classifier 11 is divided into different streams of medium material 13*a* and 13*b* and fed again to the different rolling presses 14*a* and 14*b*. The fact that, in this configuration of the invention, only a single rod cage classifier 11 is provided for the shared classification of the material being ground originating from the different rolling presses 14*a* and 14*b* as well as fine material originating from the different V classifiers 40*a* and 40*b* achieves the effect that the ground fractions of all the rolling presses 14*a* and 14*b* are mixed with one another. According to the invention, it is provided that the rolling presses 14*a* and 14*b* are arranged between at least two risers 30*a* and 30*b*. This achieves the effect of a setup of the plant as a whole that allows individual parts of the rolling presses 14*a* and 14*b* that are in need of servicing as a result of wear to be moved by means of just a single, centrally arranged lifting crane 20. The individual parts, such as roll bearings 15*a* and 16*a* or grinding rolls 17*a* and 18*a*, are very heavy and therefore cannot be moved and exchanged by simple means. Furthermore, the symmetrical setup, though exact symmetry is not important, allows the risers 30*a* and 30*b* to be able to serve as a stable load-bearing structure for the rod cage classifier 11.

The rolling presses 14*a* and 14*b* are advantageously arranged on a platform 35 in the recirculating grinding mill 10 that allows the rolling presses 14*a* and 14*b* to be displaced from their working position, in which they deliver the material being ground that is leaving them downward to the respectively present V classifier, into the servicing position, in which the grinding rolls 17*a* and 18*a* can be let down from this platform by one and the same lifting crane.

In FIG. 1, the removal of a grinding roll 17*a* from the rolling press 14*a* is graphically represented, the grinding roll 17*a* being displaced together with its roll bearing 15*a* in the machine frame 141 toward the center of the plant. In a next step, shown in dotted lines, this grinding roll/roll bearing arrangement 15*a*', 17*a*' is let down from the platform 35 by the lifting crane 20.

Figure 2:
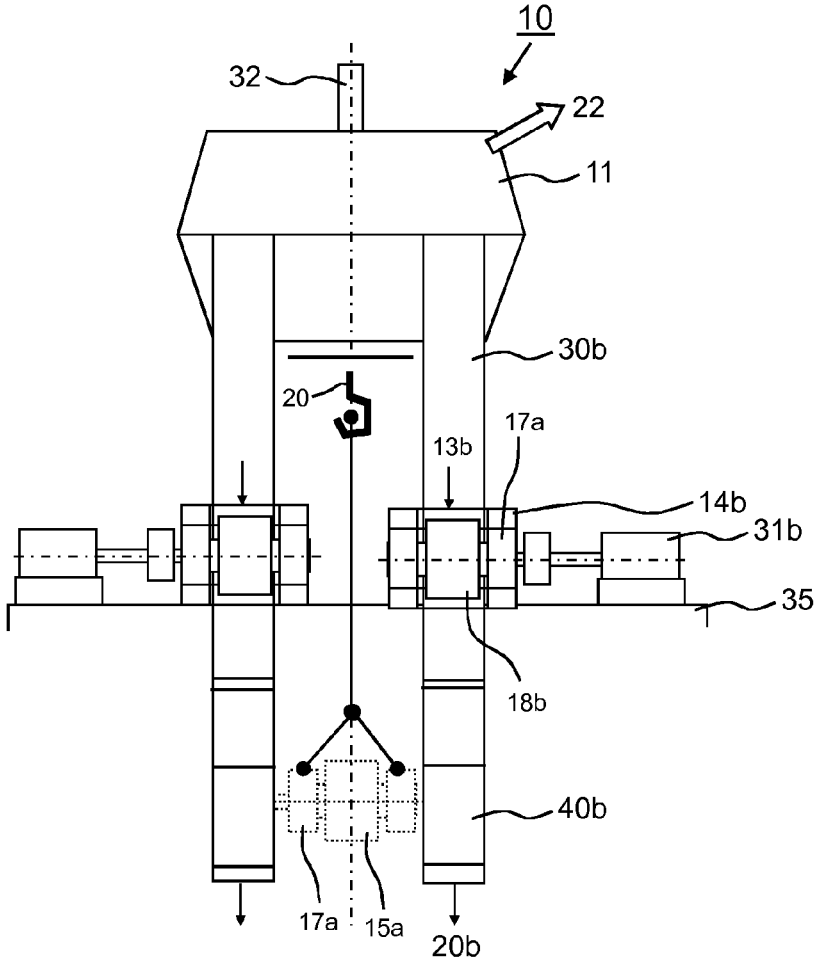
FIG. 2 shows the recirculating grinding mill from FIG. 1 in a second view.

The recirculating grinding mill 10 in FIG. 1 is represented in FIG. 2 in the plane which is indicated in FIG. 1 by the line A-A and is perpendicular to the plane of the paper.

By turning the view it becomes clear that the recirculating grinding mill 10 described here comprises four rolling presses, which are respectively arranged underneath the rod cage classifier 11. In this case, the risers are arranged at the corners of a rectangle. However, it is equally possible to choose a different polygonal arrangement of different rolling presses. When two rolling presses are used, they are arranged in a line; when three or more rolling presses are used, they are advantageously arranged at the corners of a polygon respectively corresponding to the number of rolling presses, each rolling press having a riser of its own.

In a special configuration of the invention it is also possible to bring together the stream of ground material from more than one rolling press/disagglomerator, for example in pairs, and to transport the stream of ground material that has been brought together and classified in each case through a riser. These embodiments of the recirculating grinding mill have the common feature that the rolling presses are placed within the arrangement of different risers, so that the risers can serve as a supporting structure for the shared rod cage classifier and optionally also for a roof structure.

Suitable as the classifier type for the first classifiers is a fluidized bed classifier, into which the material to be classified is directed by means of a staircase arrangement of individual metal sheets to form a fluidized bed. This fluidized bed is flowed through by classifying air approximately from a lateral direction and the finer fraction of the material to be classified is thereby blown out of the fluidized bed by the air. The coarser grains at the same time flow further and the finer grains are entrained by the stream of classifying air. The V classifiers mentioned at the beginning, cascade classifiers or combined classifier types which comprise a cascade, a staircase to maintain the fluidized bed and, for example, a horizontal rod cage classifier are suitable as fluidized bed classifiers.

Figure 3:
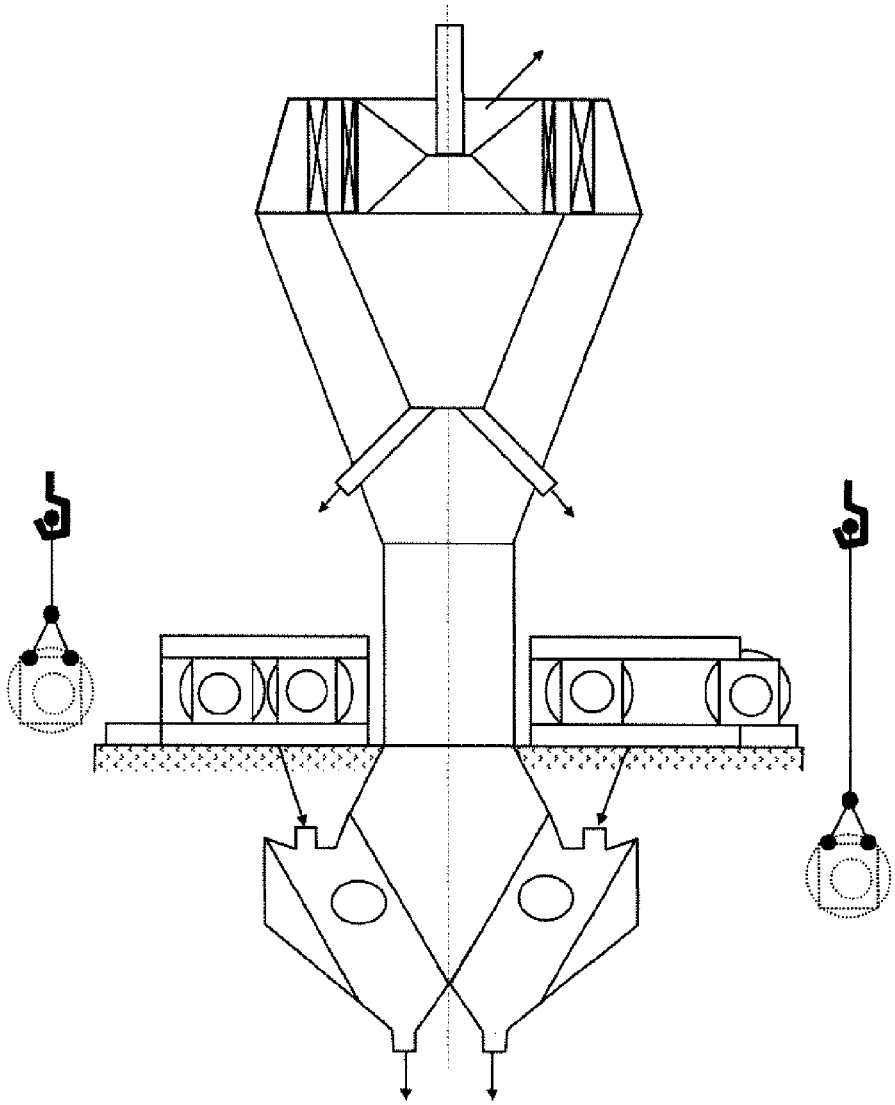
FIG. 3 shows a prior-art recirculating grinding mill.

In FIG. 3, finally, a prior-art recirculating grinding mill is represented, in which mill a central riser is used to transport the pre-classified material being ground, originating from different rolling presses, upward for the recirculation. The central arrangement means that this structure is not suitable for fastening a roof directly to the riser structure to provide protection from the weather, for which reason it is necessary to construct a roof around this plant. Furthermore, to service the rolling presses, a lifting crane must approach from different sides. For this purpose, to service the plant it is necessary to keep appropriate traveling paths available for one movable crane or to keep more than one crane available, which leads to an increase in the cost of the plant as a whole.

Figure 4:
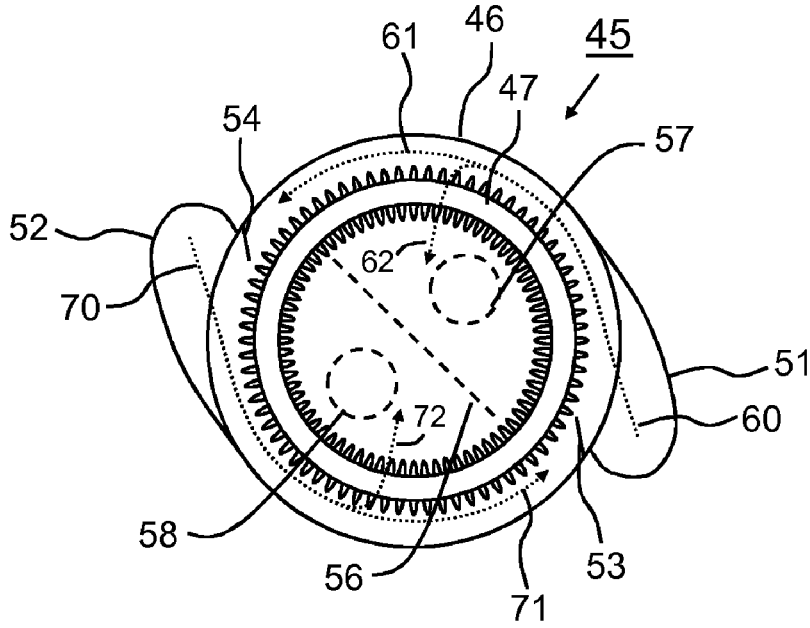
FIG. 4 shows a broken-through view from above of a rod cage classifier in a configuration of the invention.

FIG. 4 finally shows a broken-through view from above of a rod cage classifier 45 in a special configuration of the invention, by which the recirculating grinding mill 10 according to the invention offers particular advantages.

If different materials that have different grindability or grain size distribution are to be ground together, such as for example granulated blast-furnace slag along with clinker or pozzolan along with clinker, there is the problem that the different components disturb one another during the grinding. In this case, the material that is easier to grind is over-ground in the rolling presses in comparison with the material that is more difficult to grind, so that at the end of the grinding process the different materials have different physical properties. These different properties may in the end lead to problems with the quality of the end product. To solve this problem, according to the invention it is proposed to grind the different materials in at least virtually closed circuits within the recirculating grinding mill. For this purpose, the different components are fed to different pairs of rolling presses and classifiers, with these rolling presses and classifiers being adjusted specifically for grinding the individual material to be ground by way of the gap pressure, gap size, intensity and temperature of the classifying air, size of the rolling presses and/or classifiers and other specific parameters. The different material to be ground passes through the recirculating grinding mill with a shared second classifier, in which the separated fine material of the two rolling presses is mixed and drawn off, whereas the medium-material fractions of the different components remain in separate circuits. This is achieved by arranging in the shared rod cage classifier 45, at the upper end of the recirculating grinding mill 10, two separating walls 53 and 54 in the space between the rod cage 47 and the classifier housing 46 and arranging a separating wall 56 in the lower classifier cone of the rod cage classifier 45, in order to divide the space for the coarse fractions 61 and 71 separated by the rod cage classifier 45. As a result, the function of the rod cage classifier 45 changes slightly as compared with the function of a rod cage classifier of the generic type. In the rod cage classifier 45 according to the invention, two classifying material feeds 51 and 52 on opposite sides of the rod cage classifier 45 introduce different streams of material to be classified 60 and 70 into the interior of the rod cage classifier 45. In this case, some of the material to be classified is drawn through the rotating rod cage 47 by suction, together with the pneumatic transporting air which maintains the streams of material to be classified 60 and 70. This part of the material to be classified represents the fine fraction 62 and 72, which is drawn off together with the classifying or transporting air. The coarse fractions 61 and 71, however, remain in the space between the rod cage 47 and the classifier housing 46 and are prevented from mixing with one another at the latest by the separating walls 53 and 54, where they fall downward into the classifier cone. This classifier cone is likewise divided by a separating wall 56, so that the coarse fraction 61 from the material to be classified 60 comes out of the coarse-material discharge 57 and the coarse fraction 71 of the material to be classified 70 leaves the rod cage classifier 45 through the coarse-material discharge 58. The two fine fractions 62 and 72 are mixed within the rod cage and in the following gas path during the discharge. By working in this way, separate circuits form for each rolling press 14*a* and 14*b*, the respectively corresponding first classifiers 40*a* and 40*b*, the different risers 30*a* and 30*b* and within the shared rod cage classifier. An advantage of this configuration is that differently grindable components can be individually ground in the different closed circuits, it being possible for each rolling press to be set to the grindability of the material passing it. Similarly, the first classifiers corresponding to the rolling presses can be set such that optimally adapted classifying takes place. Only the fine fractions 62 and 72, after separate grinding, are intimately mixed with one another by suspension in the classifying air, so that a mixed product of high quality is obtained.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

LIST OF DESIGNATIONS

| | |
|---|---|
| 10 | recirculating grinding mill |
| 11 | rod cage classifier |
| 12a | medium-material discharge opening |
| 12b | medium-material discharge opening |
| 13a | stream of medium material |
| 13b | stream of medium material |
| 14a | rolling press |
| 14b | rolling press |
| 15a | roll bearing |
| 16a | roll bearing |
| 17a | grinding roll |
| 18a | grinding roll |
| 19a | stream of classifying air |
| 19b | stream of classifying air |
| 20 | lifting crane |
| 20a | coarse-material discharge |
| 20b | coarse-material discharge |
| 21a | stream of ground material |
| 22 | stream of fine material |
| 30a | riser |
| 30b | riser |
| 31b | drive motor |
| 32 | lead-through |
| 35 | platform |
| 40a | cascade classifier |
| 40b | cascade classifier |
| 45 | rod cage classifier |
| 46 | rod cage classifier |
| 47 | rod cage |
| 51 | classifying-material feed |
| 52 | classifying-material feed |
| 53 | separating wall |
| 54 | separating wall |
| 56 | separating wall |
| 57 | coarse-material discharge |
| 58 | coarse-material discharge |
| 60 | stream of material to be classified |
| 61 | coarse fraction |
| 62 | fine fraction |
| 70 | stream of material to be classified |
| 71 | coarse fraction |
| 72 | fine fraction |
| 141 | machine frame |

The invention claimed is:

1. A recirculating grinding mill, comprising:

at least two rolling presses for comminuting material to be ground, at least two first classifiers for classifying a coarse-grain fraction, at least one second classifier for classifying a fine-grain fraction and a medium-grain fraction from the fractions classified in the at least two first classifiers, the rolling presses, first classifiers and at least one second classifier bring arranged such that feedstock fed into the recirculating grinding mill passes the at least two rolling presses and the at least two first classifiers and then the at least one second classifier with the medium-grain fraction and the coarse fraction being fed again to the rolling presses, and the at least two first classifiers being arranged underneath the at least two rolling presses, wherein transport of the fractions classified in the at least two first classifiers is provided through at least two risers, the at least two rolling presses being arranged between the at least two risers.

2. The recirculating grinding mill as claimed in claim 1, wherein a cable of a central lifting crane is led between the at least two rolling presses.

3. The recirculating grinding mill as claimed in claim 2, wherein the at least two rolling presses are arranged on a unit which makes lateral displacement possible and the at least two rolling presses can be positioned by the unit centrally under the cable of the central lifting crane.

4. The recirculating grinding mill as claimed in claim 1, wherein the at least two rolling presses are arranged on a platform.

5. The recirculating grinding mill as claimed in claim 1, wherein at least one of classifying and drying gases bring about a pneumatic transport of a fine fraction classified in the first classifier to at least one second classifier.

6. The recirculating grinding mill as claimed in claim 1, wherein the at least two risers serve at the same time as their function as a riser also as a supporting structure for the at least one second classifier.

7. The recirculating grinding mill as claimed in claim 1, wherein the at least two first classifiers comprise static fluidized bed classifiers.

8. The recirculating grinding mill as claimed in claim 1, wherein the at least one second classifier is one of a rod cage classifier and a static air suspension classifier.

9. The recirculating grinding mill as claimed in claim 1, wherein the rolling presses and the risers are arranged at corners of a polyhedron.

10. The recirculating grinding mill as claimed in claim 9, wherein the polyhedron is a rectangle.

11. A recirculating grinding mill, comprising:

at least two rolling presses for comminuting material to be ground, at least two first classifiers for classifying a coarse-grain fraction, at least one second classifier for classifying a fine-grain fraction and a medium-grain fraction from the fractions classified in the at least two first classifiers, the rolling presses, first classifiers and the at least one second classifier being arranged such that feedstock fed into the recirculating grinding mill passes the at least two rolling presses and the at least two first classifiers and then the at least one second classifier and the medium-grain fraction and the coarse fraction are fed again to the rolling presses, and the at least two first classifiers being arranged underneath the at least two rolling presses, wherein transport of the fractions classified in the at least two first classifiers is provided through at least two risers, the at least two rolling presses being arranged between the at least two risers, and the second classifier is a rod cage classifier with a rod cage spaced within a classifier housing, the rod cage classifier having in a region between the classifier housing and the rod cage at least two separating walls, by which a space in the rod cage classifier outside the rod cage, but within the classifier housing, into which material to be classified is fed, is divided into more than one space, and these divided spaces each have at least one individual classifying-material feed and each have at least one individual coarse-material discharge.

12. The recirculating grinding mill as claimed in claim 11, wherein a cable of a central lifting crane is led between the at least two rolling presses.

13. The recirculating grinding mill as claimed in claim 12, wherein the at least two rolling presses are arranged on a unit which makes lateral displacement possible and the at least two rolling presses can be positioned by the unit centrally under the cable of the central lifting crane.

14. The recirculating grinding mill as claimed in claim 11, wherein the at least two rolling presses are arranged on a platform.

15. The recirculating grinding mill as claimed in claim 11, wherein at least one of classifying and drying gases bring about a pneumatic transport of the fraction classified in the first classifier to at least one second classifier.

16. The recirculating grinding mill as claimed in claim 11, wherein the at least two risers serve at the same time as their function as a riser also as a supporting structure for the at least one second classifier.

17. The recirculating grinding mill as claimed in claim 11, wherein the at least two first classifiers are static fluidized bed classifiers.

18. The recirculating grinding mill as claimed in claim 11, wherein the rolling presses and the risers are arranged at corners of a polyhedron.

19. The recirculating grinding mill as claimed in claim 18, wherein for each rolling press, a first classifier, a riser and a separate divided-off space of the rod cage classifier respectively form a separate grinding circuit, the fine material removed from each grinding circuit being united together with the fine material of at least one other grinding circuit on a fine material side in the rod cage classifier.

20. The recirculating grinding mill as claimed in claim 18, wherein the polyhedron is a rectangle.

* * * * *